United States Patent [19]

Strepelis et al.

[11] 3,953,299

[45] Apr. 27, 1976

[54] COKE OVEN HAVING A LOW BURNER HEATING WALL AND A HIGH BURNER HEATING WALL

[75] Inventors: John J. Strepelis, Bethlehem, Pa.; Wayne C. Gensler, Hillside, N.J.

[73] Assignee: Bethlehem Steel Corporation, Bethlehem, Pa.

[22] Filed: Aug. 14, 1974

[21] Appl. No.: 497,440

[52] U.S. Cl. ..... 202/139; 202/126; 202/220

[51] Int. Cl.[2] ..... C10B 5/02; C10B 21/12; C10B 21/18

[58] Field of Search.... 202/134, 125, 126, 140–144, 202/220, 221, 139; 201/26, 41

[56] References Cited

UNITED STATES PATENTS

| | | | |
|---|---|---|---|
| 1,824,922 | 9/1931 | Otto | 202/142 |
| 2,460,324 | 2/1949 | Wethly | 310/157 |
| 2,488,175 | 11/1949 | Davis | 202/220 X |
| 2,974,090 | 3/1961 | Schmidt | 201/41 |
| 3,476,652 | 11/1969 | Grumm | 202/142 |
| 3,838,017 | 9/1974 | Messerschmidt | 202/141 |
| 3,841,975 | 10/1974 | Jakobi et al. | 202/139 |

FOREIGN PATENTS OR APPLICATIONS

| | | | |
|---|---|---|---|
| 801,114 | 9/1958 | United Kingdom | 202/142 |
| 687,848 | 1/1940 | Germany | 202/141 |
| 531,609 | 1/1941 | United Kingdom | 202/141 |
| 479,558 | 2/1938 | United Kingdom | 202/144 |
| 501,351 | 2/1939 | United Kingdom | 202/143 |
| 699,189 | 10/1940 | Germany | 202/141 |

*Primary Examiner*—Barry S. Richman
*Assistant Examiner*—Bradley R. Garris
*Attorney, Agent, or Firm*—Joseph J. O'Keefe; Michael J. Delaney; John J. Selko

[57] ABSTRACT

A coke oven and method of heating a coke oven are provided in which the coke oven has coking chambers with a low burner heating wall on one side of the coking chamber and a high burner heating wall on the other side of the coking chamber. Heating takes place by only low burners in one heating wall and only high burners in the other heating wall.

5 Claims, 4 Drawing Figures

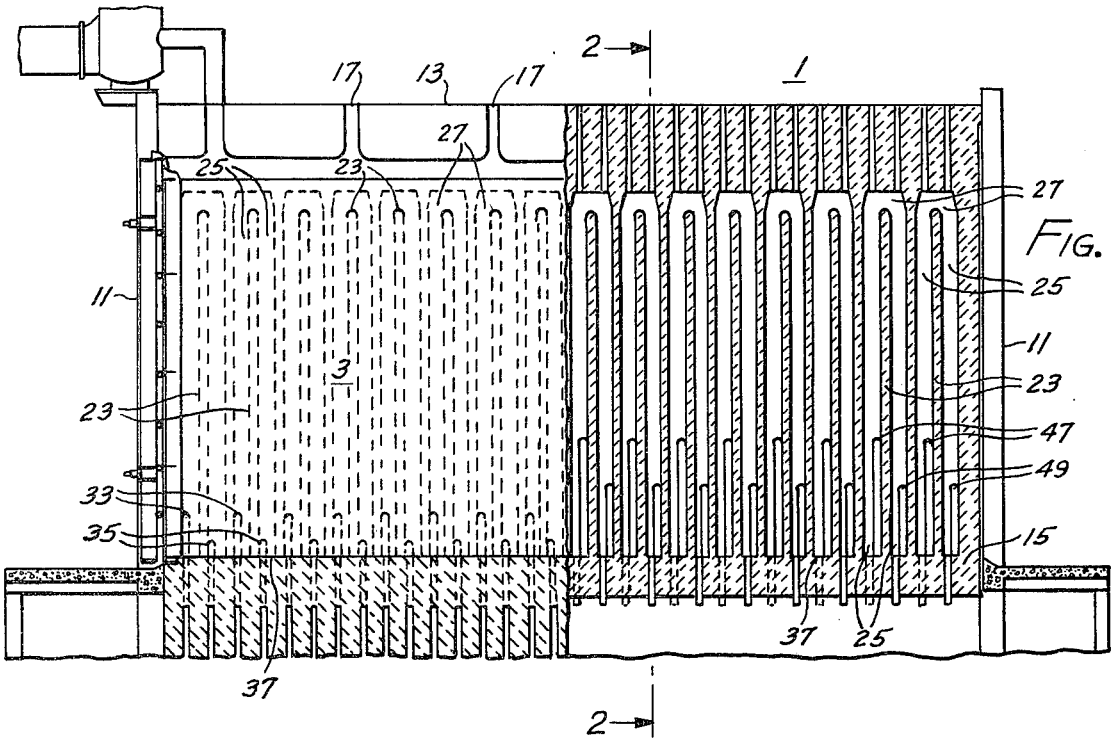
FIG. 1
FIG. 2
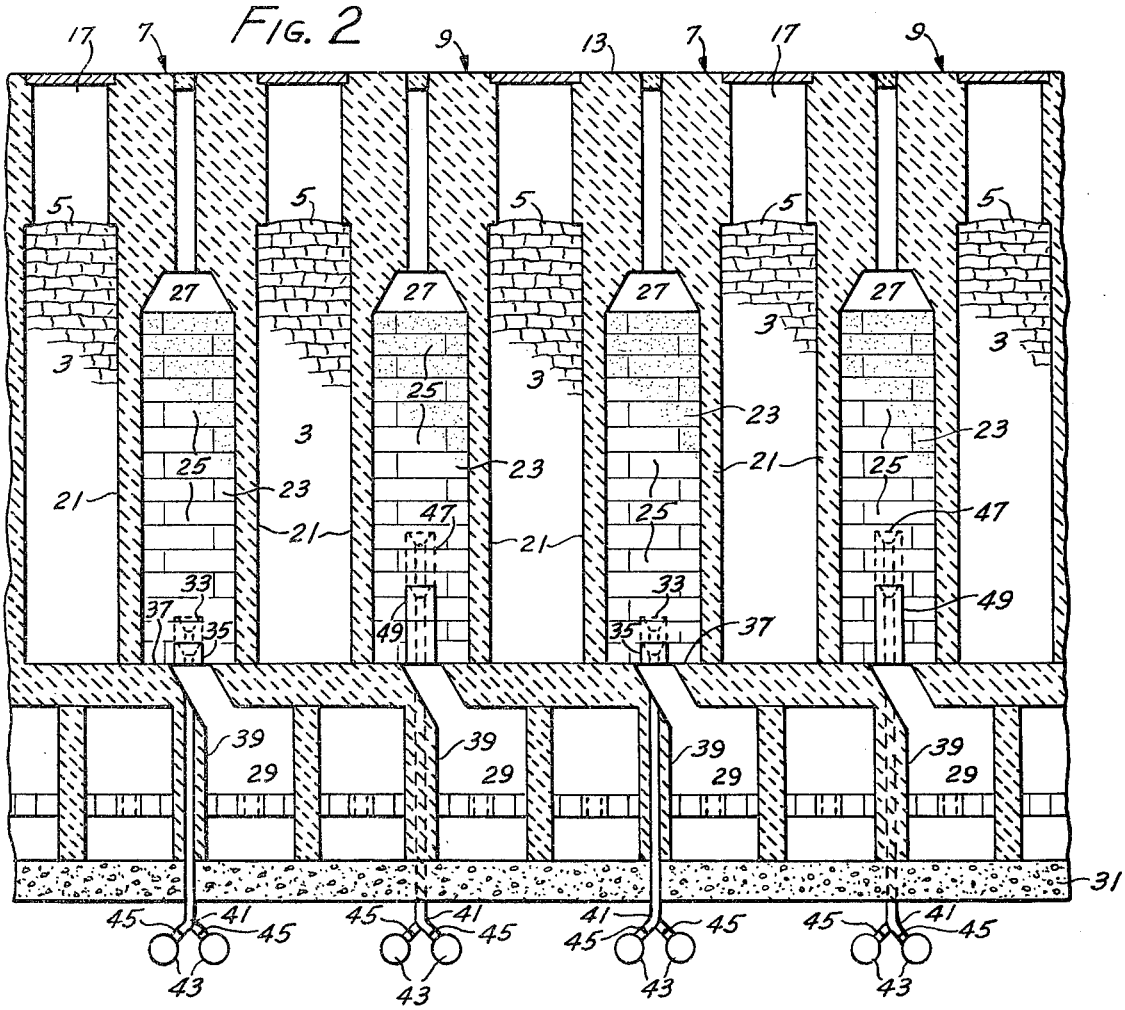

COKE OVEN HAVING A LOW BURNER HEATING WALL AND A HIGH BURNER HEATING WALL

BACKGROUND OF THE INVENTION

This invention relates to coke ovens of the type which are equipped with high and low burners in the flues.

Most modern, tall, prior art coke ovens, in order to obtain as low as possible a vertical temperature differential in the coking chambers, position in each flue a high burner and a low burner. Prior ovens are exemplified by the following U.S. Pat. Nos.

3,730,847 to Pries et al. on May 1, 1973
3,476,652 to Grumm on Nov. 4, 1969
2,460,324 to Wethley on Feb. 1, 1949
2,224,920 to Otto on Dec. 17, 1940
1,748,142 to Otto on Feb. 25, 1930

However, even with a high-low burner arrangement objectionably high vertical temperature differentials can occur. In addition for those ovens employing a high and low burner in each flue, each burner requires appropriate apparatus for operably connecting it to a source of combustion materials, making the capital cost of each battery objectionably high. Finally, mechanical maintenance costs become objectionably high for the large number of burners, orifices, manifolds and other apparatus required for these two burners per flue high-low ovens.

Thus, there is a need for a coke oven which eliminates the need for so many burners and at the same time provides a coke oven with an acceptable vertical temperature differential in the oven coking chamber.

SUMMARY OF THE INVENTION

We have discovered that the prior art problems can be solved by providing a coke oven and method for operating a coke oven in which a heating wall having only low burners is provided on one side of a coking chamber, and a heating wall having only high burners is provided on the other side of the coking chamber. Heating takes place from only low burners on one wall and only high burners on the other wall, for improved vertical temperature differential and reduced capital and maintenance costs. Low and high burner heights are defined in terms of a ratio of burner height to flue height in the range of 1:22 to 1:8 for low burners and 1:5 to 1:3 for high burners.

BRIEF DESCRIPTION OF THE DRAWINGS

FIG. 1 is a crosswise vertical section through a coke oven battery embodying the features of this invention.

FIG. 2 is a vertical section in elevation taken along lines 2—2 of FIG. 1.

DESCRIPTION OF THE PREFERRED EMBODIMENTS

Figure 3:
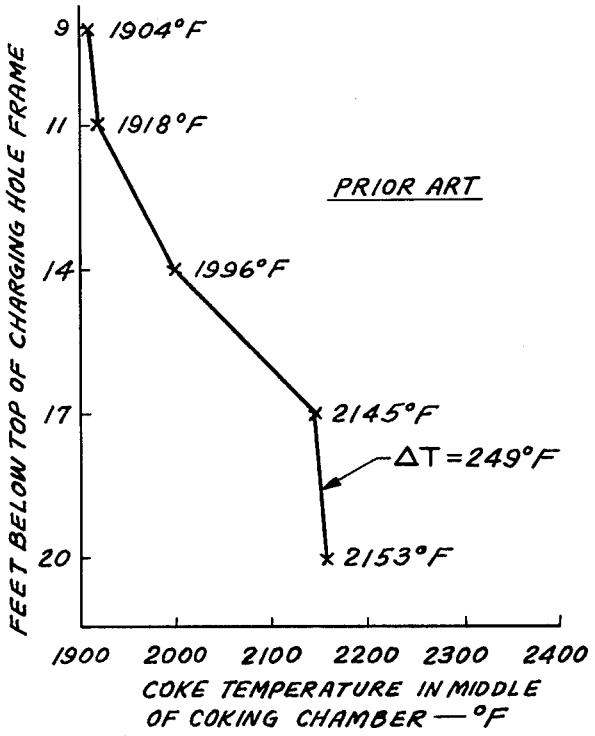
FIG. 3 is a graphical representation of the vertical temperature profile of the coal charge in a conventional high-low burner coke oven.

FIGS. 1 and 2 show a coke oven battery 1 having a plurality of horizontal coking chambers 3 filled with coal 5 and between each coking chamber 3 a refractory heating wall referred to as 7 and 9. Buckstays 11 supply lateral support and refractory roof 13 and refractory bottom member 15 help define chambers 3. Charging holes 17 in roof 13 are used to fill chamber 3, as is well known.

Each heating wall 7 and 9 contains a plurality of vertical heating flues 25. Each heating wall 7 and 9 includes a pair of spaced apart refractory heating walls referred to as oven walls 21 and a multiplicity of transversely extending refractory flue binder walls 23 which define heating flues 25. Adjoining flues 25 are connected at hairpins 27, as is well known.

Beneath refractory bottom member 15 are shown checker chambers 29 for regenerative heating, as is well known. Checker chambers 29 rest on battery pad 31 which in turn is supported by conventional means not shown.

Within a heating wall 7 on one side of a coking chamber 3 are a plurality of only low burners 33 and 35, with one burner per flue 25. By low burners, we mean that the burners 33 and 35 do not extend to a significant height above the line of the bottom 37 of flues 25, as is well known in the art. Burners 33 and 35 can be at the same height but for optimum heating, we prefer to vary the heights so that the height of a burner 33 in one vertical flue 25 is different from the height of burner 35 in the next adjoining flue 25. We prefer a range of low burner heights between 10 13/16 inches and 20 11/16 inches above the bottom of flue 25 for a coking chamber having a height of approximately 16 feet. We prefer to define the location of burners 33 and 35 by means of a ratio between the height of the burners 33 and 35 to the height of flue 25 with the preferable burner heights in the ratio range of 1:8 to 1:22.

Each burner 33 and 35 is connected by riser bricks 39 to a riser pipe 41 which, in turn, connects to a manifold 43 which supplies gas for combustion. An orifice 45 in riser pipe 41 controls the amount of gas entering burners 33 and 35. Orifices require constant maintenance to prevent their becoming blocked. Because this invention eliminates the need for one half of these riser pipes, burners, orifices and other connecting apparatus, maintenance is made much easier.

Air enters through checker chambers 29, as is well known. Fuel and air mix and combustion occurs in flues 25 to heat heating wall 7 only with low burners 33 or 35. Heating wall 7 is referred to hereinafter as a low burner heating wall.

Within heating wall 9 on the other side of coking chamber 3 from heating wall 7 are a plurality of only high burners 47 and 49, with one burner per flue. By high burners, we mean that the burners 47 and 49 extend upwardly into flue 25 a significant distance above bottom 37, as is well known.

Burners 47 and 49 can be at the same height but for optimum heating, we prefer to vary the height of burners 47 and 49 so that the height of a burner 47 in one vertical flue 25 is different from the height of a burner 49 in the next adjoining flue 25. We prefer a range of high burner heights between 30½ inches and 55⅛ inches above the bottom 37 of flue 25 for a coking chamber 3 having a height of approximately 16 feet. We prefer to define the location of burners 47 and 49 by means of a ratio between the height of the burners 47 and 49 to the height of flue 23 with the preferable burner heights in the ratio range of 1:5 to 1:3.

In addition, we prefer to have the minimum height of the high burners 47 and 49 above the maximum height of the low burners 38 and 35.

Each burner 47 and 49 is connected by riser bricks 39 to a riser pipe 41 which, in turn, connects to a manifold 43 which supplies gas for combustion. Orifice 45 in riser pipe 41 controls the amount of gas entering burners 47 and 49. As with low burners 33 and 35, orifices 45 require constant maintenance and this invention reduces the amount of maintenance by eliminating one half of the required orifices, burners, riser pipes, and other connecting apparatus.

Air enters through checker chambers 29, as is well known. Fuel and air mix and combustion occurs in flues 25 to heat heating wall 9 only with high burners 47 and 49. Heating wall 9 is referred to hereinafter as a high burner heating wall.

Therefore, it can be understood that we provide a low burner heating wall 7 having only low burners 33 and 35 on one side of each coking chamber 3 and a high burner heating wall 9, having only high burners 47 and 49 on the other side of coking chamber 3. All other construction features of battery 1 are conventional for an underjet fired hairpin regenerative coke oven battery.

The low burner heating wall 7 eliminates all high burners 47 and 49 in each flue of low burner heating wall 7 plus the associated appararus such as manifolds 43, riser pipes 41 and orifices 45. The high burner heating wall 9 eliminates all low burners 33 and 35 in each flue 25 plus the associated apparatus listed above. Therefore, the invention effects a substantial reduction in battery capital cost as well as a reduction in maintenance efforts, while providing improved vertical temperature distribution in coking chamber 3.

Figure 4:
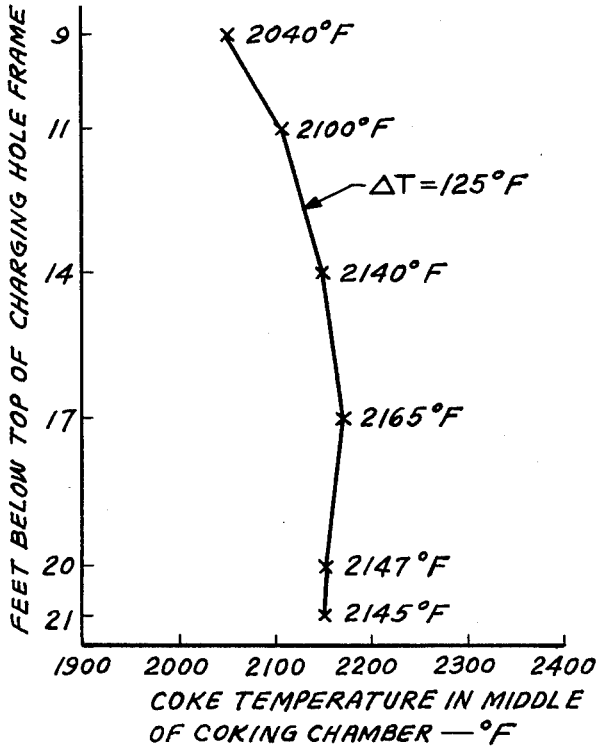
FIG. 4 is a graphical representation similar to FIG. 3 illustrating the vertical temperature profile of the coal charge in a coke oven embodying the apparatus and method of this invention.

FIG. 3 shows the vertical temperature distribution of coke one half hour before pushing in a chamber 3 using the prior art burner configuration, with a high and low burner in each flue 25. FIG. 4 shows the vertical temperature distribution of coke one half hour before pushing in a chamber 3 according to the apparatus and method of this invention.

FIG. 3 shows a vertical temperature differential of 249° F., which is undesirably high and could lead to variable coke properties. FIG. 4 shows that the invention provides a vertical temperature differential of only 125° F., a significant improvement. Also, as shown in FIG. 4 the highest temperature occurs in chamber 3 near the bottom of chamber 3 where maximum heat is required since the greatest coal bulk density occurs in this region. Also, the temperature gradient in chamber 3 is such that the temperature in the highest portion of chamber 3 is relatively lower than the rest of the chamber, minimizing the possibility of cracking of hydrocarbon gases which are a source of objectionable carbon deposits in the top of chamber 3. Finally, because heating wall 7 contains low burners 33 and 35, more heat if needed can be supplied to the lower region of chamber 3 by adjustment to the fuel type and rate supplied to burners 33 and 35.

OPERATION

In operation, coal is charged and leveled in coke chamber 3 by conventional means. Coking proceeds by heating only by low burners 33 and 35 in a heating wall on one side of said coking chamber 3, while heating only by high burners 47 and 49 in a heating wall on the other side of coking chamber 3.

For prior art batteries already equipped with a high and low burner in each flue a low burner heating wall and a high burner heating wall can be obtained by operating only low burners in one wall and only high burners in the other wall.

While this invention has been disclosed for an underjet fired hairpin type regenerative coke oven, it could be employed in other types of conventional coke oven batteries.

We claim:

1. In combination, a coke oven battery having a plurality of horizontal coking chambers and between each said coking chamber a heating wall containing a plurality of vertical heating flues; said heating walls and heating flues comprising a. a low burner heating wall having plural hairpin flues therein on one side of each of said coking chambers each said flue having a burner means, said burner means consisting of a low burner in which the height of said low burner relative to the height of the flue is in the ratio of about 1:22 to 1:8; and b. a high burner heating wall having plural hairpin flues therein on the other side of each of said coking chambers each said flue having a burner means, said burner means consisting of a high burner in which the height of said high burner relative to the height of the flue is in the ratio of about 1:5 to 1:3; and c. means for operably connecting said low and high burners for heating to a fuel and air source; whereby improved vertical temperature distribution in the material within each said coking chamber is obtained.

2. The invention of claim 1 in which the height of said low burner in one of said low burner heating wall flues is different from the height of the low burner in the next adjoining low burner heating wall flue.

3. The invention of claim 2 in which the height of said high burner in one of said low burner heating wall flues is different from the height of the high burner in the next adjoining high burner heating wall flue.

4. The invention of claim 3 in which the height range of said low burner is between 10 13/16 inches and 20 11/16 inches above the bottom of said low burner heating wall flue, and the height of said coking chamber is approximately 16 feet.

5. The invention of claim 3 in which the height range of said high burner is between 30½ inches and 55⅛ inches, above the bottom of said high burner heating wall flue, and the height of said coking chamber is approximately 16 feet.

* * * * *